United States Patent [19]

Kunichika et al.

[11] Patent Number: 4,840,875

[45] Date of Patent: Jun. 20, 1989

[54] DESENSITIZING GUM FOR LITHOGRAPHIC PRINTING PLATE COMPRISING A POLYBASIC AND MONOESTER OF POLYSACCHARIDE

[75] Inventors: Kenji Kunichika; Hiroshi Matsumoto, both of Shizuoka; Akira Shingu, Tokyo, all of Japan

[73] Assignees: Fuji Photo Film Co., Ltd., Kanagawa; Oji-National Co., Ltd., Tokyo, both of Japan

[21] Appl. No.: 151,989

[22] Filed: Feb. 3, 1988

[30] Foreign Application Priority Data

Feb. 4, 1987 [JP] Japan ..... 62-24355

[51] Int. Cl.[4] ..... G03C 5/24; G03C 5/34

[52] U.S. Cl. ..... 430/309; 430/325; 430/331

[58] Field of Search ..... 430/309, 325, 331; 101/451; 106/2, 210, 213

[56] References Cited

U.S. PATENT DOCUMENTS

| | | | |
|---|---|---|---|
| 3,870,527 | 3/1975 | Kryger et al. | 106/2 |
| 4,186,250 | 1/1980 | Garrett et al. | 430/302 |
| 4,200,688 | 4/1980 | Garrett et al. | 430/302 |
| 4,259,202 | 3/1981 | Tonaka et al. | 252/107 |
| 4,259,451 | 3/1981 | Steenbergen et al. | 435/253 |
| 4,475,460 | 10/1984 | Matsumoto | 101/465 |
| 4,574,151 | 3/1986 | Adams | 536/31 |
| 4,601,974 | 7/1986 | Kita et al. | 430/309 |
| 4,719,172 | 1/1988 | Matsumoto et al. | 430/309 |
| 4,731,119 | 3/1988 | Toyama et al. | 106/2 |

FOREIGN PATENT DOCUMENTS

| | | |
|---|---|---|
| 0077120 | 4/1983 | European Pat. Off. . |
| 1435172 | 5/1976 | United Kingdom . |

*Primary Examiner*—Paul R. Michl
*Assistant Examiner*—Patrick A. Doody
*Attorney, Agent, or Firm*—Burns, Doane, Swecker & Mathis

[57] ABSTRACT

An emulsion type desensitizing gum comprises at least one polybasic acid monoester derivative of polysaccharide. The desensitizing gum exhibits high shelf stability and the lithographic printing plate to which the desensitizing gum has been applied hardly causes the background contamination of printed matters and is excellent in both the ink receptivity of the image areas and the desensitizing ability of the non-image areas.

19 Claims, No Drawings

DESENSITIZING GUM FOR LITHOGRAPHIC PRINTING PLATE COMPRISING A POLYBASIC AND MONOESTER OF POLYSACCHARIDE

BACKGROUND OF THE INVENTION

1. Field of the Invention

The present invention relates to a desensitizing gum for lithographic printing plate, more particularly to a desensitizing gum of emulsion type containing a specific polysaccharide derivative and a gumming-up process using the desensitizing gum.

2. Description of the Prior Art

When a lithographic printing plate is prepared, a desensitizing gum, so-called gumming solution, is applied to the surface of the lithographic printing plate as the final step of the preparation thereof The application of such a desensitizing gum is carried out for the purposes of preventing the deposition of any contaminants on the surface of the lithographic printing plate possibly occurring during storage after the lithographic printing plate is produced, which possibly leads to the background contamination of printed matters, as well as preventing the formation of any defects due to the storage thereof in piles or the collision with foreign substances. The application of such a desensitizing gum is an essential process for making lithographic printing plates in view of preventing the nonimage areas of the lithographic printing plate from lowering the hydrophilic property due to oxidation upon being directly exposed to air and further enhancing the hydrophilicity thereof.

As such a gumming solution, a composition comprising an aqueous solution of gum arabic having a concentration of about 15 to 30% by weight and optionally a surfactant, a pH adjusting agent, a preservative and the like has been used over the past years.

However, the gum arabic is a natural product which is obtained only in limited districts and the yield thereof is greatly influenced by a variety of conditions such as the weather in the districts. Therefore, a steady supply thereof is not expected at all.

For this reason, many attempts have been directed to the use of various water-soluble organic polymers in place of gum arabic as the desensitizing gum.

For instance, Japanese Patent Un-examined Published Application (hereinafter referred to as "J. P. KOKAI") No. 54-97102 discloses dextrin, sterabic, stractan, alginates, plyacrylic acids, hydroxyethyl cellulose, polyvinylpyrrolidone, polyacrylamide, methyl cellulose, hydroxypropyl cellulose, hydroxymethyl cellulose and salts of carboxyalkyl cellulose. In addition, Japanese Patent Publication for Opposition Purpose (hereunder referred to as "J. P. KOKOKU") No. 54-41921 discloses pullulan and derivatives thereof; J. P. KOKAI No. 58-197091 discloses polyvinylpyrrolidone; and J. P. KOKAI No. 56-133193 discloses polyvinyl alcohol. Moreover, J. P. KOKAI No. 5957242 discloses the following compounds as modified starch derivatives:

Roasted starch such as British gum; dextrins modified with enzymes such as enzyme dextrin and Schardinger dextrin; acid decomposed starch represented by solubilized starch; alpha-starch such as modified alpha-starch and unmodified alpha-starch; esterified starch such as phosphated starch, fatty starch, sulfated starch, nitrated starch, starch xanthate and starch carbamate; etherified starch such as carboxyalkyl starch, hydroxyalkyl starch, sulfoalkyl starch, cyanoethyl starch, allyl starch, benzyl starch, carbamylethyl starch and dialkylamino starch; cross-linked starch such as methylol cross-linked starch, hydroxyalkyl cross-linked starch, phosphoric acid cross-linked starch and dicarboxylic acid cross-linked starch; starch graft copolymers such as starch-polyacrylamide copolymer, starchpolyacrylic acid copolymer, starch-polyvinyl acetate copolymer, starch-polyacrylonitrile copolymer, cationic starch-polyacrylic acid ester copolymer, cationic starchpolyvinyl copolymer, starch-polystyrene-maleic acid copolymer and starch-polyethylene oxide copolymer.

However, either of these desensitizing gum is inferior to gum arabic in the ability to desensitize the non-image areas of the lithographic printing plate to which they are applied.

On the contrary, the desensitizing ability of gum arabic is so strong that the ink receptivity of the image areas of the lithographic printing plate is substantially lowered if the gum arabic i used as the desensitizing gum and, therefore, it has often been encountered that a great deal of unacceptable printed matters must be produced before printed matters having a satisfactory ink density during press operation are produced.

As the gumming solution which can eliminate such a disadvantage in some degree, there has been known an emulsified gumming solution comprised of an oil phase consisting of a petroleum fraction containing a lipophilic substance such as a lipophilic surfactant soluble in organic solvents and a water phase containing a water-soluble organic polymeric compound. In such an emulsified gumming solution, the gum arabic exhibits not only the desensitizing ability but the stabilization effect for such emulsion as a protective colloid.

On the other hand, various kinds of the aforementioned water-soluble organic polymers exhibit only a low protective colloidal effect and they simply provide a gumming solution which causes the separation of the aqueous phase from the oil phase within several days

SUMMARY OF THE INVENTION

Accordingly, it is a purpose of the present invention to provide a desensitizing gum having a high desensitizing ability, which rarely causes the background contamination of the printed matters when applied to the surface of a lithographic printing plate.

It is another purpose of the present invention to provide an emulsion type desensitizing gum having a good stability.

The inventors of the present invention have conducted various studies to achieve the foregoing purposes and have found that the aforementioned purposes can be effectively achieved by using a polybasic acid monoester of a polysaccharide as the water-soluble organic polymeric compound and thus have completed the present invention.

Consequently, the present invention provide a desensitizing gum comprising at least one polybasic acid monoester of a polysaccharide and a gumming-up process using the desensitizing gum.

DETAILED EXPLANATION OF THE INVENTION

The present invention will hereunder be explained in more detail.

(Polysaccharides)

Preferred examples of polysaccharides as used herein to obtain polybasic acid monoester derivatives are those listed below:

HOMOGLYCANS (i) Glucans: cellulose, starch, glycogen, charonin, laminaran, dextran;

(ii) Fructan: inulin, levan;

(iii) Mannan: mannan derived from Phytelephas macrocarpa;

(iv) Xylan: xylan derived from rice plant straw;

(v) Galacturonan: pectinic acid;

(vi) Mannuronan: alginic acid;

(vii) N-acetylglucosamine polymer.

HETEROGLYCANS (i) Diheteroglycan: guaran, konjak mannan, hyaluronic acid, heparin, chondroitin sulfate;

(ii) Triheteroglycan: mesquite gum, gum Ghatti, other various mucilage derived from plants, rubber like substances, polysaccharides derived from bacteria;

(iv) Tetraheteroglycan: gum arabic, mucilage derived from flax seeds, other various mucilage, rubber like substances, polysaccharides derived from bacteria.

The aforementioned polysaccharides include those insoluble in water by themselves. However, they can be used in the present invention if they are made water-soluble by converting to polybasic acid monoester derivatives.

It is preferable to use starch type polysaccharide from the economical point of view and examples thereof include those derived from potato, sweet potato, wheat, corn, rice, tapioca, waxy corn, glutinous rice. Particularly preferred are starch derived from glutinous seeds such as those derived from waxy corn and glutinous rice, having a high amylopectin content, and fractionated amylopectin.

The amylopectin type starch exhibits a variety of advantages such as a high stability with time since they hardly cause aging which is a property peculior to starch. In addition, the desensitizing gum of the present invention would be excellent in the ability to prevent the contamination of non-image areas so far as the amylopectin type starch is used therein.

(Polybasic acid)

Preferred examples of the polybasic acids which may be used in the present invention are as follows:

Itaconic acid, maleic acid, phthalic acid, trimellitic acid, pyromellitic acid, endomethylene tetrahydrophthalic acid, chlorendic acid, methyl endomethylene tetrahydroxy phthalic acid, tetrahydroxy phthalic acid, diphenic acid citraconic acid, glutaconic acid, glutaric acid, succinic acid, hexaisobutenyl succinic acid, nonyl succinic acid, n-octyl succinic acid, 2-ethyl-2-methylsuccinic acid, dimethylbenzyl succinic acid, octenyl succinic acid, hexenyl succinic acid, decenyl glutaric acid, dodecenyl succinic acid and the like. Particularly preferred are succinic acids such as octenyl succinic acid among others.

(Polybasic Acid Monoester Derivatives of Polysaccharides)

The polybasic acid monoesters of polysaccharides as used herein may conveniently be obtained by esterifying a polysaccharide with an anhydride of the aforementioned polybasic acid.

Preferred examples of such polybasic acid monoesters of polysaccharides include dibasic acid monoester such as succinic acid monoester starch, octenyl succinic acid monoester starch, hexenyl succinic acid monoester starch, decenyl glutaric acid monoester starch, dodecenyl succinic acid monoester starch and maleic acid monoester starch. Among them, succinic acid monoester starches such as octenyl succinic acid monoester starch provide particularly preferred effect.

In addition, the polybasic acid monoester of the polysaccharide as used herein have at least one free carboxyl group and they may suitably be used in the form of an alkali metal salt such as lithium salt or an ammonium salt according to need.

In general, when a desensitizing gum having a high viscosity is applied to a lithographic printing plate with an automated gum-coater, the formation of "streaks" and "nonuniformity" is sometimes observed on the coated surface. Moreover, the desensitizing gum preferably has a low viscosity since the desensitizing gum must be applied to the plate as a relatively thick layer in order to protect the printing plate from causing defects and contamination, although the thickness of the layer depends on the kind of the water-soluble polymer used. Therefore, the viscosity of the polybasic acid monoester of the polysaccharide as used in the present invention is preferably not more than 500 cps measured on an aqueous solution of 20% by weight at 20° C. (B type viscometer BL; manufactured and sold by TOKYO KEIKI CO., LTD.), more preferably 2 to 300 cps.

(Degree of Substitution of the Polybasic Acid Monoester of Polysaccharide)

In general, the formation of the polysaccharide derivatives is accompanied by the change (or modification) of the chemical structure of the glucose units in the polysaccharide molecule. The degree of modification or the degree of substitution thereof takes an important role in suppression of the aging or gelation of the polysaccharides, improvement in the water retention characteristic and enhancement of the hydrophilicity or lipophilicity thereof. The term "degree of substitution" herein means averaged number of the hydroxyl groups per one glucose unit, which are esterified with the polybasic acid. For instance, if all the three hydroxyl groups in one unit of glucose are completely esterified, the degree of substitution is equal to 3, the maximum value thereof in such case.

In the present invention, preferred polybasic acid monoesters of the polysaccharides have a degree of substitution ranging from 0.001 to 0.5, more preferably 0.005 to 0.3. This is because the desensitizing ability of the resultant desensitizing gum according to the present invention becomes insufficient if the polysaccharide derivative having the degree of substitution of less than 0.001 is used in the gum.

On the contrary, if the degree of substitution is more than 0.5, not only the polysaccharide derivative is synthesized with considerable practical difficulties, but no further improvement in the desensitizing ability of the desensitizing gum is expected.

(Desensitizing Gum)

In the desensitizing gum according to the present invention, the content of the polybasic acid monoester of the polysaccharide preferably ranges from 1 to 30% by weight, more preferably 3 to 25% by weight. As the content thereof is reduced below 1% by weight, the effect attained by using the same is reduced while as the content thereof is increased above 30% by weight, the ink receptivity of the image areas is lowered which is accompanied by the production of a large number of unacceptable printed matters before the printed matters having a satisfactory ink density are certainly obtained when the printing operation is commenced.

In addition to the aforementioned component, the instant desensitizing gum may optionally include various known components. Such components will hereunder be explained in more detail.

WATER-SOLUBLE RESINS

The instant desensitizing gum may contain various kinds of water-soluble resins other than the polysaccharide derivatives such as those discussed above.

As examples of naturally occurring polymers, there may be mentioned such starch as sweet potato starch, potato starch, tapioca starch, wheat starch and corn starch; such a polymer derived from seaweeds as carrageenan, laminaran, mannan derived from seaweeds, funori, Irish moss, agar and sodium alginate; such mucilage derived from plants as tororo-aoi mucin, mannan, quince seed mucin, pectin, tragacanth gum, karaya gum, xanthine gum, guar bean gum locust bean gum, gum arabic, carob gum and benzoin gum; such mucilage derived from bacteria as homopolysaccharide, e.g., dextran, glucan and levan, and heteropolysaccharide, e.g., succinoglucan; and such a protein as glue, gelatin, casein and collagen.

In addition to semi-natural substance (semi-synthetic product) such as alginic acid propylene glycol ester, there may be mentioned such a fibrous derivatives and processed starch as viscose, methyl cellulose, ethyl cellulose, methyl ethyl cellulose, hydroxyethyl celllose, carboxymethyl cellulose, hydroxypropyl cellulose, hydroxypropyl methyl cellulose, hydroxypropyl ethyl cellulose and hydroxypropyl methyl cellulose phthalate.

As examples of the processed starch, there may be mentioned such roasted starch as white dextrin, yellow dextrin and British gum; such an enzyme modified dextrin as enzyme dextrin and Schardinger dextrin; such an acid decomposed starch as those represented by solubilized starch; such an oxidized starch as those represented by dialdehyde starch; such an alpha-starch as modified alphastarch and unmodified alpha-starch; such an esterified starch as phosphated starch, fatty starch, sulfated starch, nitrated starch, xanthogenic acid starch and carbamic acid starch; such an etherified starch as carboxyalkyl starch, hydroxyalkyl starch, sulfoalkyl starch, cyanoethyl starch, allyl starch, benzyl starch, carbamylethyl starch and dialkylamino starch; such a cross-linked starch as methylol cross-linked starch, hydroxyalkyl cross-linked starch, phosphoric acid cross-linked starch and dicarboxylic acid cross-linked starch; and such a starch graft copolymer as starch polyacrylamide copolymer, starch polyacrylic acid copolymer, starch polyvinyl acetate copolymer, starch polyacrylonitrile copolymer, cationic starch polyacrylate copolymer, cationic starch polyvinyl copolymer, starch polystyrene maleic acid copolymer and starch polyethylene oxide copolymer.

As examples of the synthetic substances, there may be mentioned polyvinyl alcohol; such a modified polyvinyl alcohol as polyvinyl alcohol partially modified with acetal, allyl modified polyvinyl alcohol, polyvinyl methyl ether, polyvinyl ethyl ether and polyvinyl isobutyl ether; such a polyacrylic acid derivative or a polymethacrylic acid derivative as sodium polyacrylate, partially saponified polyacrylate, partially saponified polyacrylate copolymer, polymethacrylic acid salt and polyacrylamide; polyethylene glycol, polyethylene oxide, polyvinyl pyrrolidone, copolymer of polyvinyl pyrrolidone with vinyl acetate, carboxy vinyl polymer, styrol maleic acid copolymer and styrol crotonic acid copolymer.

These water-soluble resins may be used in combination of two or more of them and may be incorporated into the instant desensitizing gum in an amount of not more than 20% by weight of the finisher.

pH ADJUSTING AGENTS

It is convenient to use the instant desensitizing gum under an a idic condition of pH 2 to 6. In order to adjust pH to 2 to 6, in general a mineral acid, an organic acid, an inorganic salt, an alkali agent or the like is added to the instant desensitizing finisher to control the pH value thereof. The amount thereof used in the gum ranges from 0.01 to 3% by weight.

Examples of the mineral acids include nitric acid, sulfuric acid and phosphoric acid. Examples of the organic acids include citric acid, acetic acid, oxalic acid, malonic acid, p-toluene sulfonic acid, tartaric acid, malic acid, lactic acid, levulinic acid, phytic acid, benzoic acid, butyric acid, maleic acid, picolinic acid and organic phosphonic acid. Examples of the inorganic salts include water-soluble alkali metal salt and ammonium salt of nitric acid, phosphoric acid, sulfuric acid, molybdic acid, acetic acid, polyphosphoric acid and boric acid, such as sodium nitrate, potassium nitrate, ammonium nitrate, sodium dihydrogen phosphate, disodium hydrogen phosphate, potassium dihydrogen phosphate, dipotassium hydrogen phosphate, ammonium dihydrogen phosphate, diammonium hydrogen phosphate, sodium sulfate, potassium sulfate, ammonium sulfate, sodium molybdate, potassium molybdate, ammonium molybdate, sodium acetate, potassium acetate, ammonium acetate, sodium tripolyphosphate, sodium metaphosphate, sodium pyrophosphate, sodium borate and ammonium borate.

As alkaline agents, there may be mentioned such an alkali metal hydroxide as sodium hydroxide, potassium hydroxide and lithium hydroxide or such an amine as ammonia, monoethanol amine, diethanol amine and triethanol amine. These pH adjusting agents may be used alone or in combination.

SURFACTANTS

Moreover, the surface conditions of the resultant coated layer or the like is improved by adding a surfactant to the instant desensitizing gum. Examples of such surfactants usable in the present invention include anicnic surfactants, nonionic surfactants, amphoteric surfactants and cationic surfactants.

For instance, there may be mentioned such anionic surfactants as fatty acid salts, alkylbenzene sulfonates, alkyl sulfates, alpha-olefin sulfonates, alkyl phosphate salts, dialkyl sulfosuccinate salts, polyoxyethylene alkyl ether sulfates, polyoxyethylene alkyl ether phosphates, alkyl naphthalene sulfonates, N-lauroyl sarcosinate, sulfonates of naphthalene formalin condensate diphenyl ether disulfonates; such nonionic surfactants as polyoxyethylene alkyl ethers, polyoxyethylene alkylphenol ethers, polyoxyethylene-polyoxypropylene block polymers, polyoxyethylene sorbitan fatty acid esters, polyoxyethylene glycerin fatty acid esters, polyethylene glycol fatty acid esters, polyoxyethylene fatty acid amines, fatty acid monoglycerides, sorbitan fatty acid esters, pentaerythritol fatty acid esters, sucrose fatty acid esters and amine oxides.

Examples of the amphoteric surfactants include alkyl carboxybetaine type ones, alkylaminocarboxylic acid type ones and alkylimidazoline type ones. Examples of the cationic surfactants include tetraalkyl ammonium salts, trialkyl benzyl ammonium salts and alkyl imidazolinium salts. In addition to these surfactants listed above, fluorinated surfactants, silicone type surfactants and the like may also be used in the present invention.

Among these surfactants, anionic surfactants and/or nonionic surfactants are particularly effective in the present invention. These surfactants may be used alone or in combination. The amount thereof used is not critical, however, preferably they are used in an amount of 0.01 to 10% by weight of the total weight of the desensitizing gum.

AGENTS FOR MAKING LITHOGRAPHIC PLATE INK RECEPTIVE (LIPOPHILIZING AGENT)

In addition to the aforementioned components, the instant desensitizing gum may contain a lipophilizing agent according to need. Examples thereof are plasticizers having a solidification point of not more than 15° C. and a boiling point of not less than 300° C. under 1 atmospheric pressure, which include, for instance, such hydrocarbons as turpentine oil, xylene, toluene, n-heptane, solvent naphtha, kerosine, mineral spirit, petroleum cut having a boiling point of about 120° C. to 250° C.; such phthalic acid diesters as dibutyl phthalate, diheptyl phthalate, di-n-octyl phthalate, di-(2-ethylhexyl)-phthalate, dinonyl phthalate, didecyl phthalate, dilauryl phthalate and butyl benzyl phthalate; such aliphatic dibasic acid esters as dioctyl adipate, butyl glycol adipate, dioctyl azelate, dibutyl sebacate, di-(2-ethylhexyl)-sebacate and dioctyl sebacate; such epoxidized triglycerides as epoxidized soybean oil; such phosphates as tricresyl phosphate, trioctyl phosphate and tris-chloroethyl phosphate; and such benzoates as benzyl benzoate.

In addition, there may be used such ketones as cyclohexanone; such halogenated hydrocarbons as ethylene dichloride; and such ethylene glycol ethers as ethylene glycol monomethyl ether, ethylene glycol monophenyl ether and ehtylene glycol monobutyl ether together with the aforementioned solvents.

Moreover, Examples of the aliphatic acids which may be employed together with the solvents listed above, there may be mentioned such saturated aliphatic acids as caproic acid, enanthic acid, caprylic acid, pelargonic acid, capric acid, undecylic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, lacceric acid and isovaleric acid; and such unsaturated aliphatic acids as acrylic acid, crotonic acid, isocrotonic acid, undecylenic acid, oleic acid, elaidic acid, cetoleic acid, erucic acid, brassidic acid, sorbic acid, linoleic acid, linolenic acid, arachidonic acid, propiolic acid, stearolic acid, clupanodonic acid, tariric acid and licanic acid. Preferred examples thereof are those which can be in the liquid state at 50° C., more preferably those having 5 to 25 carbon atoms and most preferably those having 8 to 21 carbon atoms.

These lipophilizing agents may be used alone or in combination. Preferred amount thereof falls within the range of from 0.01 to 10% by weight, and more preferably 0.05 to 5% by weight.

WETTING AGENTS AND PRESERVATIVES

In addition, the instant desensitizing gum may contain a wetting agent which includes, for instance, lower alcohols such as glycerin, ethylene glycol and triethylene glycol. These wetting agents are used in the composition of the present invention in an amount of preferably 0.1 to 5.0% by weight and more preferably 0.5 to 3.0% by weight. Moreover, the instant desensitizing gum may contain a preservative and the like. For instance, there may be added thereto benzoic acid and derivatives thereof, phenol, formalin, sodium dehydroacetic acid, 3-isothiazolone type compound or the like in an amount of from 0.005 to 2.0% by weight of the finisher.

PS PLATES

The desensitizing gum according to the present invention is adapted for a variety of lithographic printing plates, in particular the instant desensitizing gum may suitably be applied to those obtained by imagewise exposing to light and developing a presensitized plate comprised of an aluminum plate as a substrate having thereon provided with a light-sensitive layer (a plate for use in making lithographic printing plate, to which light-sensitivity is previously imparted and which is named PS plate).

Examples of such PS plates include those composed of an aluminum substrate having thereon provided with a lightsensitive layer consisting of a mixture of a diazo resin (a salt of the condensate of p-diazodiphenyl amine with paraformaldehyde) and shellac, such as those disclosed in British Pat. No. 1,350,521; negative working PS plates comprised of an aluminum plate having thereon provided with a light-sensitive layer consisting of a mixture of a diazo resin and a polymer having hydroxyethyl methacrylate units or hydroxyethyl acrylate units as the principal repeating unit, such as those disclosed in British Patent Nos. 1,460,978 and 1,505,739; and positive working PS plates comprised of an aluminum plate having thereon provided with a light-sensitive layer consisting of a mixture of an o-quinonediazide light-sensitive compound and a novolak type phenol resin, such as those disclosed in J. P. KOKAI No. 50125806 125806.

In addition, there may preferably be used in the present invention a PS plate comprised of an aluminum plate having thereon provided with a light-sensitive layer consisting of a photolytically cross-linkable photopolymer as specifically disclosed in the specification of U.S. Pat. No. 3,860,426; a PS plate comprised of an aluminum plate having thereon provided with a light-sensitive layer of a photopolymerizable photopolymer composition as described in the specifications of U.S. Pat. Nos. 4,072,528 and 4,072,527; a PS plate comprised of an aluminum plate having thereon provided with a light-sensitive layer consisting of a mixture of an azide and a water-soluble polymer as disclosed in the specifications of British Pat. Nos. 1,235,281 and 1,495,861 may also preferably be used in the present invention.

METHOD FOR USING THE DESENSITIZING GUM LITHOGRAPHIC PLATE FINISHER

An example of the use of the instant desensitizing gum will hereunder be explained, in which a PS plate is utilized.

First of all, the PS plate is imagewise exposed to light and then developed to form a lithographic printing plate.

The developer as used in the foregoing developing process is an alkali solution in which the principal solvent is water and which contains an alkali agent and optionally an organic solvent, an anionic surfactant, an inorganic salt and the like according to need.

As such alkali agents, there may be conveniently used such an inorganic alkali agent as sodium silicate, potassium silicate, potassium hydroxide, sodium hydroxide, lithium hydroxide, sodium tertiary phosphate, sodium bicarbonate, sodium carbonate, potassium carbonate and ammonium carbonate; and such an organic alkali agent as mono-, di- or triethanol amine. The content of the alkali agent in the developer is preferably in the range of from 0.05 to 4% by weight and more preferably from 0.1 to 2% by weight.

Useful examples of the organic solvents include alcohols such as n-propyl alcohol and benzyl alcohol and glycol ethers such as phenyl cellosolve. The content of the organic solvent in the developer preferably ranges from 0.5 to 15% by weight and more preferably from 1 to 5% by weight.

Examples of the anionic surfactant include salts of alkyl sulfate such as sodium lauryl sulfate; salts of alkylaryl sulfonate such as dodecyl benzene sulfonate; sulfonates of dibasic fatty acid ester such as sodium di-(2-ethylhexyl)-sulfosuccinate; alkylnaphthalene sulfonates such as sodium n-butylnaphthalene sulfonate; and polyoxyethylene alkyl (phenol) ether sulfates, however, the alkylnaphthalene sulfonates such as sodium n-butylnaphthalene sulfonate are suitably be used among others. The content of the anionic surfactant in the developer preferably falls within the range of from 0.1 to 5% by weight and more preferably 0.5 to 1.5% by weight.

As the inorganic salts, a water-soluble alkali or alkaline earth metal salt of an acid such as phosphoric acid, silicic acid, carbonic acid and sulfurous acid and in particular an alkali or alkaline earth metal sulfite is preferably used. The content of these inorganic salts ranges from 0.05 to 5% by weight and more preferably from 0.1 to 1% by weight.

It is also useful to further add an antifoaming agent, a wetting agent and the like to the developer according to need.

In order to develop a PS plate, which has been imagewise exposed to light, with the aforementioned developer, any known methods of development may be employed. Specific examples thereof include a method in which the imagewise exposed PS plate is immersed in a developer; a method in which the light-sensitive layer of the PS plate imagewise exposed to light is sprayed with a developer injected from a lot of nozzles; a method wherein the lightsensitive layer of the PS plate imagewise exposed to light is wiped with a sponge dampened with a developer; and a method wherein a developer is roll coated on the surface of the light-sensitive layer of the PS plate.

The lithographic printing plate thus developed in accordance with the aforementioned method is then washed with water and the water is squeezed out from the surface of the plate. Then, a proper amount of the instant desensitizing gum is poured onto the plate and the plate is rubbed with a sponge so as to coat the whole surface of the plate with the gum. Thus, the non-image areas on the plate is protected and the resultant lithographic printing plate is ready to storage.

Other methods for gumming-up may also be used in the present invention and examples of such methods are a treatment by an automated gumming-up machine, which is effected after development and water washing processes; a method for gumming-up effected immediately after the development without water washing; and a treatment by an automated gumming-up machine, effected after the development and the subsequent water washing with a small amount of washing water or after the treatment with a liquid for rinsing containing a surfactant.

When commencing the printing operation, the gum on the surface of the lithographic plate is removed by water washing (so-called gum-removing) and then the printing operation is carried out in accordance with usual procedures or it can be immediately commenced without so-called degumming procedure if the instant desensitizing gum is used. In the printing operation, printed matters having a sufficiently satisfiable distinctness can be obtained immediately after the commencement of the printing operation without producing a large number of unacceptable printed matters as encountered in conventional desensitizing gum. Moreover, the non-image areas of the lithographic printing plate maintain high hydrophilicity and, therefore, the plate permits the production of good printed matters having no background contamination.

The present invention will hereunder be explained in more detail with reference to the following working Examples, however, it should be appreciated that the invention is not restricted to these Examples. Moreover, the effects practically achieved according to the instant desensitizing gum will also be discussed in comparison with comparative examples.

EXAMPLE 1

(i) The Instant Desensitizing Gum

120 Parts by weight of water-soluble octenyl succinic acid monoester of starch derived from Waxy corn (degree of substitution=0.013; viscosity at 20° C. (concn.=20% by weight)=40 cps) and 80 parts by weight of yellow dextrin (roasted dextrin) were dissolved in 752.3 parts by weight of pure water. To the aqueous solution there was added 30 parts by weight of aqueous gum arabic solution (Baumé degree (Bé)=14°), and then 10 parts by weight of an anionic surfactant, alkyl diphenyl ether disulfonate (manufactured and sold by SANYO CHEMICAL INDUSTRIES, LTD under the trade name of SANDET BL), 0.2 parts by weight of ethyl benzoate, 0.5 parts by weight of sodium dehydroacetate, 3 parts by weight of ammonium phosphate and 4.0 parts by weight of 85% phosphoric acid were added to the resultant solution to obtain a desensitizing gum according to the present invention.

(ii) Lithographic Printing Plates

An aluminum plate of 0.24 mm thick was degreased by immersing it in 7% aqueous solution of sodium tertiary phosphate at 60° C. After water washing, the aluminum plate was grained by rubbing it with a nylon brush while pouring an aqueous suspension of pumice stone thereon. After water washing, the aluminum plate was immersed in 5% aqueous solution of potassium silicate ( molar ratio, $SiO_2/K_2O=2.0$) maintained at 70° C. for 30 to 60 seconds followed by sufficient water washing and drying.

To the surface of the thus treated aluminum plate there was applied a light-sensitive liquid consisting of 2.0 parts by weight of 2-hydroxyethylmethacrylate copolymer (synthesized in accordance with the method disclosed in Example 1 of British Pat. No. 1,505,739), 0.12 parts by weight of 2-methoxy-4-hydroxy-5-benzoylbenzene sulfonate of the condensate of p -diazodiphenyl amine and paraformaldehyde, 0.03 parts by weight of Oil Blue #603 (manufactured and sold by ORIENT CHEMICAL INDUSTRIES LTD.), 15 parts by weight of 2-methoxy ethanol, 10 parts by weight of methanol and 5.0 parts by weight of ethylene chloride to obtain a presensitized plate (PS plate) having thereon a light-sensitive layer of 1.8 g/m$^2$ (dry weight). The PS plate was exposed to light through a half-tone negative transparency and then was developed with an aqueous developer consisting of 3.0 parts by weight of sodium sulfite, 30.0 parts by weight of benzyl alcohol, 20.0 parts by weight of triethanol amine, 5.0 parts by weight of monoethanol amine, 10.0 parts by weight of sodium t-butylnaphthalene sulfonate and 1000 parts by weight of pure water.

(iii) Comparative Test

The lithographic printing plate thus obtained was divided into three pieces. One of them was coated with a conventional desensitizing gum, gum arabic of Bé 7° (aqueous solution of about 15%), and excess thereof was wiped away with cloth (Sample A).

One of the remaining two pieces was coated with the desensitizing gum of the present invention prepared above and likewise the excess thereof was wiped away with cloth (Sample B). The other remaining piece of the lithographic plate was not coated with a desensitizing gum at all (Sample C).

These three Samples A, B and C were stored in a thermo-hygrostat at a temperature of 45° C. and a humidity of 85% for 3 days and then they were set on a printing press, Heidelberg KOR-D PRINTING PRESS, to carry out printing operation in accordance with usual manner. The number of unacceptable printed matters which are compelled to be produced until distinct printed matters were obtained was not less than 100 with respect to Sample A, 10 with respect to Sample B and 8 with respect to Sample C. In the course of printing operation, Samples A and B were hardly contaminated while Sample C was very easily contaminated. Sample B on which the desensitizing gum of the present invention was coated was excellent in both the ink receptivity of the image areas and the desensitizing ability of the non-image areas.

EXAMPLE 2

(i) The instant desensitizing Gum

There were dissolved, in 756.2 parts by weight of pure water, 100 parts by weight of succinic acid monoester of water-soluble starch derived from waxy corn, having a low viscosity (degree of substitution=0.01; viscosity at 20° C. (concn.=20% by weight)=50 cps), 80 parts by weight of hexenyl succinic acid ester of water-soluble starch derived from waxy corn (degree of substitution=0.012; viscosity at 20° C. (concn.=20% by weight)=100 cps ), 50 parts by weight of enzyme decomposed dextrin (manufactured and sold by NICHIDEN CHEMICAL COMPANY under the trade name of AMICOL 1B), 0.8 parts by weight of an anionic surfactant, dialkyl sulfosuccinate (manufactured and sold by Kao Corporation under the trade name of PELEX OTR), 2.0 parts by weight of polyoxyethylene nonyl phenol ether (manufactured and sold by Kao Corporation under the trade name of EMULGEN #920) 0.5 parts by weight of phenol, 0.5 parts by weight of sodium dehydroacetate, 6 parts by w eight of sodium hexametaphosphate and 4 parts by weight of phosphoric acid (85%) in order to obtain a desensitizing gum according to the present invention.

(ii) Lithographic Printing Plate

On the other hand, 1 part by weight of polyhydroxy phenyl naphthoquinone-1,2-diazido-5-sulfonate obtained by the condensation polymerization of acetone and pyrogallol disclosed in U.S. Pat. No. 3,635,709 and 2 parts by weight of novolak type cresol-formaldehyde resin were dissolved in 40 parts by weight of methyl cellosolve to form a lightsensitive liquid. An aluminum plate of 0.2 mm thick which had been grained was sufficiently washed and then dried. To the aluminum plate thus treated was applied the foregoing light-sensitive liquid by a rotary coating machine and dried to form a positive working presensitized plate having thereon a light-sensitive layer of about 0.2 g/m$^2$ after drying. Thereafter, the PS plate was exposed to light through a half-tone positive transparency, developed with 3% aqueous solution of sodium silicate, water washed and dried.

(iii) Comparative Example

The lithographic printing plate thus obtained was cut into three pieces. One of them was coated with a conventional desensitizing gum, gum arabic of Bé 14° (about 27% aqueous solution of gum arabic), and excess thereof was wiped off with cloth (Sample A).

One of the remaining two pieces was coated with the desensitizing gum of the present invention prepared above and likewise the excess thereof was wiped away with cloth (Sample B).

The remaining lithographic plate was not coated with a desensitizing gum at all (Sample C).

These three Samples A, B and C were stored in a thermo-hygrostat at a temperature of 45° C. and a humidity of 85% for 7 days and then they were set on a printing press, Heidelberg KOR-D PRINTING PRESS, to carry out printing operation in accordance with usual manner.

The number of spoiled printed matters produced before clear printed matters were obtained was 35 with respect to Sample A, 5 with respect to Sample B and 3 with respect to Sample C. In the course of printing operation, Samples A and B were hardly contaminated while Sample C was very easily contaminated. Sample B to which the desensitizing gum according to the present invention was applied was excellent in both the ink receptivity of the image areas and the desensitizing ability of the non-image areas.

EXAMPLE 3

(i) The Instant Desensitizing Gum

In 643.2 parts by weight of pure water, there were dissolved, under heating, 190 parts by weight of decenyl glutaric acid ester of water-soluble starch derived from waxy corn (degree of substitution=0.02; viscosity at 20° C. (concn.=20% by weight)=45 cps) and 80 parts by weight of gum arabic aqueous solution (Bé=14°). Then, 25 parts by weight of glycerin, 3.5 parts by weight of phosphoric acid, 5.0 parts by weight of ammonium phosphate, 1.0 part by weight of sodium dehydroacetate and 0.3 parts by weight of ethyl benzoate were dissolved in the foregoing solution under stirring (hereunder referred to as liquid A).

On the other hand, 20 parts by weight of sodium dilauryl sulfosuccinate, 15 parts by weight of polyoxyethylene nonyl phenol ether (manufactured and sold by Kao Atlas Corporation under the trade name of EMULGEN #903) and 5 parts by weight of sorbitan monolaurate were dissolved in 12 parts by weight of dioctyl phthalate to form a liquid B. Then, the liquid B was dropwise added slowly to the liquid A prepared above with stirring the solution to form a dispersion and then the dispersion was treated with a homogenizer manufactured and sold by FISHER SCIENTIFIC CO. to form an emulsion. The viscosity of the desensitizing gum (emulsion) thus prepared was 27 cps at 25° C.

(ii) The same lithographic printing plate as used in Example 1 was employed in this Example.

(iii) Comparative Example

The lithographic printing plate was cut into three pieces. One of them was coated with a conventional desensitizing gum, gum arabic of Bé 14°, and excess thereof was wiped off with cloth (Sample A). One of the remaining two pieces was coated with the desensitizing gum of the present invention prepared above and likewise the excess thereof was wiped away with cloth (Sample B). The other remaining piece of the lithographic plate was not coated with a desensitizing gum at all (Sample C). These three Samples A, B and C were stored in a thermo-hygrostat under a temperature of 45° C. and a humidity of 85% for 7 days and then they were set on a printing press, Hiderberg KOR-D PRINTING PRESS and the printing operation was carried out.

The number of spoiled printed matters produced before clear printed matters were obtained was not less than 100 with respect to Sample A, 8 with respect to Sample B and 5 with respect to Sample C. However, Sample C was very easily contaminated. The desensitizing gum used in Sample B provided sufficiently satisfactory results.

EXAMPLE 4

In 722 parts by weight of pure water, 160 parts by weight of dodecenyl succinic acid monoester of water-soluble starch derived from waxy corn (degree of substitution=0.008; viscosity at 20° C. (concn.=20% by weight)=60 cps) and 60 parts by weight of water-soluble polyoxypropylene modified starch (manufactured and sold by NICHIDEN CHEMICAL CO. under the trade name of PENON JE 66) were dissolved under heating at 60° to 70° C.

Then, 25 parts by weight of glycerin, 4 parts by weight of phosphoric acid, 5.0 parts by weight of ammonium citrate and 0.5 part by weight of phenol were added to the foregoing solution with stirring to form a liquid A.

On the other hand, 12 parts by weight of dibutyl sebacate, 3 parts by weight of benzyl alcohol, 18 parts by weight of sodium dilauryl sulfosuccinate, 20 parts by weight of polyoxyethylene nonyl phenol ether (manufactured and sold by Kao Atlas Corporation under the trade name of EMULGEN #903) and 5 parts by weight of sorbitan monooleate were dissolved together to form liquid B.

The liquid B was dropwise added slowly to the liquid A prepared in the same manner as in Example 3 with stirring to form a dispersion and then the dispersion was treated with a homogenizer to form an emulsion.

The resultant emulsion was applied to the surface of the same positive working light-sensitive lithographic printing plate as used in Example 2. As a result, it was found that the number of spoiled printed matters produced before clear ones were obtained was 7 even after it was stored at a temperature of 45° C. and a humidity of 85% for 7 days and the contamination thereof was not observed at all. Thus, the emulsion exhibited extremely satisfactory performance as the desensitizing gum.

EXAMPLE 5

(i) The Instant Desensitizing Gum

A desensitizing gum according to the present invention was prepared by dissolving 100 parts by weight of maleic acid monoester of water-soluble potato starch (degree of substitution=0.015; viscosity at 20° C. (concn.=20% by weight)=70 cps), 120 parts by weight of carboxymethylated waxy corn starch (degree of substitution=0.15; viscosity at 20° C. (concn.=20% by weight)=100 cps), 10 parts by weight of carboxymethyl cellulose (manufactured and sold by DAI-ICHI KOGYO YAKUHIN (SEIYAKU) CO., LTD. under the trade name of CELLOGEN 6A), 3 parts by weight of polyethylene glycol octylphenyl ether (manufactured and sold by DAI-ICHI KOGYO YAKUHIN CO., LTD. under the trade name of NOIGEN EA143), 5 parts by weight of sodium alkyl sulfonate (manufactured and sold by TAKEMOTO YUSHI CO., LTD. under the trade name of PIONIN A32), 5 parts by weight of formalin (37%), 3 parts by weight of dehydroacetic acid, 6 parts by weight of ammonium primary phosphate and 2 parts by weight of phosphoric acid in 746 parts by weight of pure water.

(ii) Lithographic Printing Plate

The same lithographic printing plate as used in Example 2 was utilized in this Example.

(iii) Comparative Example

In accordance with the same procedures as in Example 2, Samples A, B and C were produced except that the instant desensitizing gum prepared above was used.

These three Samples A, B and C were stored in a thermo-hygrostat at a temperature of 45° C. and a humidity of 85% for 7 days and then they were set on a printing press, Heidelberg KOR-D PRINTING PRESS and the printing operation was carried out in usual manner.

The number of spoiled printed matters produced before clear printed matters were obtained was 38 with respect to Sample A, 6 with respect to Sample B and 3 with respect to Sample C. In the course of the printing operation, Samples A and B were hardly contaminated while Sample C was very easily contaminated. Sample B in which the desensitizing gum was used was found excellent in both the ink receptivity of the image areas and the desensitizing ability of the nonimage areas.

EXAMPLE 6

In 653.2 parts by weight of pure water, there were dissolved, under heating, 160 parts by weight of maleic acid monoester of waxy corn starch (degree of substitution=0.013; viscosity at 20° C. (concn.=20% by weight)=40 cps) and 100 parts by weight of aqueous solution of gum arabic (Bé=14°). Then, 25 parts by weight of glycerin, 3.5 parts by weight of phosphoric acid, 5.0 parts by weight of ammonium phosphate, 1.0 part by weight of sodium dehydroacetate and 0.3 part by weight of ethyl benzoate were dissolved, under stirring, in the solution prepared above to form a liquid A.

On the other hand, 20 parts by weight of sodium dilauryl sulfosuccinate, 15 parts by weight of polyoxyethylene nonyl phenol ether (manufactured and sold by Kao Atlas Corporation under the trade name of EMULGEN #903) and 5 parts by weight of sorbitan monolaurate were dissolved in 12 parts by weight of dioctyl phthalate to form liquid B. Then, the liquid B was dropwise added slowly to the liquid A prepared above while stirring the solution to form a dispersion and then the dispersion was treated with a homogenizer manufactured and sold by FISHER SCIENTIFIC CO. to form an emulsion. The viscosity of the desensitizing gum (emulsion) thus prepared was 27 cps at 25° C.

(ii) The same lithographic printing plate as used in Example 1 was used in this Example.

(iii) Comparative Example

The lithographic printing plate was divided into three pieces. One of them was coated with gum arabic of Bé14° and excess thereof was wiped off with cloth (Sample A). One of the remaining two pieces was coated with the desensitizing gum of the present invention prepared above and likewise the excess thereof was wiped away with cloth (Sample B). The other remaining piece of the lithographic plate was not coated with a desensitizing gum at all (Sample C). As in Example 1, these three Samples A, B and C were stored in a thermo-hygrostat under a temperature of 45° C. and a humidity of 85% for 7 days and then they were set on a printing press, Heidelberg KOR-D PRINTING PRESS and the printing operation was carried out.

The number of spoiled printed matters produced before clear printed matters were obtained, was not less than 100 with respect to Sample A, 7 with respect to Sample B and 4 with respect to Sample C. However, Sample C was very easily contaminated during printing. The desensitizing gum used in Sample B provided sufficiently satisfactory results

EXAMPLE 7

In 657.5 parts by weight of pure water, there were dissolved, under heating, 100 parts by weight of octenyl succinic acid monoester of waxy corn starch (degree of substitution=0.014; viscosity at 20° C. (concn.=20% by weight)=48 cps), 120 parts by weight of enzyme modified hydroxypropyl starch (degree of substitution=0.03; viscosity at 20° C. (concn.=20% by weight)=15 cps) and 30 parts by weight of roasted dextrin. Then, 25 parts by weight of glycerin, 4 parts by weight of phosphoric acid, 5.0 parts by weight of ammonium citrate and 0.5 parts by weight of phenol were dissolved in the solution prepared above while stirring to form a liquid A.

On the other hand 12 parts by weight of dibutyl sebacate, 3 parts by weight of benzyl alcohol, 18 parts by weight of sodium dilauryl sulfosuccinate, 20 parts by weight of polyoxyethylene nonyl phenol ether (manufactured and sold by Kao Atlas Corporation under the trade name of EMULGEN #903) and 5 parts by weight of sorbitan monooleate were dissolved together to form liquid B.

The liquid B was dropwise added slowly to the liquid A prepared in the same manner as in Example 4 with stirring to form a dispersion and then the dispersion was treated with a homogenizer to form an emulsion.

The resultant emulsion was applied to the surface of the same positive working light-sensitive lithographic printing plate as used in Example 2. As a result, it was found that the number of spoiled printed matters produced before clear ones were obtained was 7 even after it was stored at a temperature of 45° C. and a humidity of 85% for 7 days and the contamination thereof was not observed at all. Thus, the emulsion exhibited extremely satisfactory performance as the desensitizing gum.

EXAMPLE 8

150 Parts by weight of succinic acid monoester of water-soluble waxy corn starch (degree of substitution=0.011; viscosity at 20° C. (concn.=20% by weight)=55 cps) and 50 parts by weight of enzymatically treated dextrin (manufactured and sold by NICHIDEN CHEMICAL CO., LTD. under the trade name of AMICOL 1B) were dissolved in 749.8 parts by weight of pure water. To the aqueous solution thus prepared was added 30 parts by weight of gum arabic aqueous solution of Bé 14° and there were further added thereto 7 parts by weight of an anionic surfactant, alkyl diphenyl ether disulfonate (manufactured and sold by SANYO CHEMICAL INDUSTRIES, LTD. under the trade name of SANDET BL), 3 parts by weight of dialkyl sulfosuccinate (manufactured and sold by Kao Corporation under the trade name of PELEX OT-P), 0.3 parts by weight of ethyl benzoate, 0.4 part by weight of sodium dehydroacetate, 5.0 parts by weight of hexametaphosphoric acid, 1.5 parts by weight of citric acid and 3 parts by weight of phosphoric acid (85%) to obtain a desensitizing gum according to the present invention.

(ii) The same lithographic printing plate as used in Example 1 was employed in this Example.

(iii) Comparative Example

The lithographic printing plate was divided into three pieces. One of them was coated with a conventional desensitizing gum, gum arabic of Bé 7° (about 15% aqueous solution), and excess thereof was wiped away with cloth (Sample A).

One of the remaining two pieces was coated with the desensitizing gum of the present invention prepared above and likewise the excess thereof was wiped away with cloth (Sample B). The other remaining piece of the lithographic plate was not coated with a desensitizing gum at all (Sample C).

These three Samples A, B and C were stored in a thermo-hygrostat under a temperature of 45° C. and a humidity of 85% for 3 days and then they were set on a printing press, Heidelberg KOR-D PRINTING PRESS and the printing operation was carried out in usual manner.

The number of spoiled printed matters produced before clear printed matters were obtained was not less than 100 with respect to Sample A, 10 with respect to Sample B and 8 with respect to Sample C. Samples A and B were hardly contaminated while Sample C was very easily contaminated. Sample B in which the desensitizing gum was used was excellent in both the ink receptivity of the image areas and the desensitizing ability of the non-image areas.

As seen from the foregoing discussions and Examples, the lithographic printing plates, to which the desensitizing gum according to the present invention is applied, hardly cause the background contamination; are excellent in both the ink receptivity of the image areas and the desensitizing ability of the non-image areas; and exhibit high shelf stability.

What is claimed is:

1. In a gumming-up process which comprises applying to a lithographic printing plate comprising an oleophilic image area and a hydrophilic non-image area, a desensitizing gum comprising a least one polybasic acid monoester of polysaccharide, said polybasic acid being selected from the group consisting of itaconic acid, maleic acid, phthalic acid, trimellitic acid, pyromellitic acid, endomethylene tetrahydrophthalic acid, chlorendic acid, methyl endomethylene tetrahydroxy phthalic acid, tetrahydroxy phthalic acid, diphenic acid, citraconic acid, glutaconic acid, glutaric acid, succinic acid, hexaisobutenyl succinic acid, nonyl succinic acid, n-octyl succinic acid, 2-ethyl-2-methylsuccinic acid, dimethylbenzyl succinic acid, octenyl succinic acid, hexenyl succinic acid, decenyl glutaric acid and dodecenyl succinic acid.

2. The process of claim 1 wherein the content of the polybasic acid monoester of polysaccharide is in the range of from 1 to 30% by weight of the finisher.

3. The process of claim 2 wherein the content of the polybasic acid monoester of polysaccharide is in the range of from 3 to 25% by weight of the finisher.

4. The process of claim 1 wherein it is used in the acidic range of pH 2 to 6.

5. The process of claim 1 wherein the polybasic acid monoester of polysaccharide is used in the form of an alkali metal salt or an ammonium salt.

6. The process of claim 1 wherein the polysaccharide is starch.

7. The process of claim 6 wherein the starch is a glutinous seed starch.

8. The process of claim 1 wherein the polysaccharide is a fractionated amylopectin.

9. The process of claim 1 wherein the polybasic acid monoester derivative of polysaccharide is a dibasic acid monoester.

10. The process of claim 9 wherein the polybasic acid monoester derivative is a succinic acid monoester.

11. The process of claim 1 wherein the degree of substitution of the polybasic acid monoester is in the range of from 0.001 to 0.5.

12. The process of claim 11 wherein the degree of substitution of the polybasic acid monoester is in the range of from 0.005 to 0.3.

13. The process of claim 1 wherein the viscosity of the aqueous solution of the polybasic acid monoester is not more than 500 cps measured at a concentration of 20% by weight and a temperature of 20° C.

14. The process of claim 13 wherein the viscosity of the aqueous solution of the polybasic acid monoester is in the range of from 2 to 300 cps measured at a concentration of 20% by weight and a temperature of 20° C.

15. The process of claim 1 wherein it further comprises at least one water-soluble resin in an amount of not more than 20% by weight of the finisher.

16. The process of claim 1 wherein it further comprises at least one surfactant selected from the group consisting of anionic and nonionic surfactants in an amount of 0.01 to 10% by weight of the finisher.

17. The process of claim 1 wherein it further comprises a wetting-agent in an amount of 0.1 to 5.0% by weight of the finisher.

18. The process of claim 1 wherein it further comprises a preservative in an amount of 0.005 to 2.0% by weight of the finisher.

19. The process of claim 10, wherein said succinic acid monoester is octenyl succinic acid monoester.

* * * * *